US007549785B2

(12) United States Patent
Faunce

(10) Patent No.: US 7,549,785 B2
(45) Date of Patent: Jun. 23, 2009

(54) NIGHT LIGHTING SYSTEM

(76) Inventor: Michael J Faunce, 11885 SW. Bull Mountain, Tigard, OR (US) 97224

( * ) Notice: Subject to any disclaimer, the term of this patent is extended or adjusted under 35 U.S.C. 154(b) by 17 days.

(21) Appl. No.: 11/497,773

(22) Filed: Aug. 2, 2006

(65) Prior Publication Data

US 2007/0053173 A1 Mar. 8, 2007

Related U.S. Application Data

(60) Provisional application No. 60/706,868, filed on Aug. 10, 2005.

(51) Int. Cl.
*H01R 33/00* (2006.01)

(52) U.S. Cl. ..... 362/641; 362/95; 362/640; 362/642; 362/643; 362/209

(58) Field of Classification Search ..... None
See application file for complete search history.

(56) References Cited

U.S. PATENT DOCUMENTS 4,508,943 A * 4/1985 Pfeiffer et al. ..... 200/17 R
4,755,913 A * 7/1988 Sleveland ..... 362/95
4,835,343 A * 5/1989 Graef et al. ..... 174/66
4,873,469 A * 10/1989 Young et al. ..... 315/155
5,485,356 A * 1/1996 Nguyen ..... 362/95
5,660,459 A * 8/1997 Appelberg ..... 362/84
5,670,776 A * 9/1997 Rothbaum ..... 250/214 AL
5,833,350 A * 11/1998 Moreland ..... 362/95
6,423,900 B1 * 7/2002 Soules ..... 174/66
2006/0209531 A1 * 9/2006 Tiesler et al. ..... 362/95

* cited by examiner

*Primary Examiner*—Sandra L O'Shea
*Assistant Examiner*—Danielle Allen
(74) *Attorney, Agent, or Firm*—Mark S. Hubert

(57) ABSTRACT

Disclosed is a night lighting system retrofittable with existing wall switches for illuminating an area around the wall switches. The night lighting system comprises: a wall plate having at least one switch receiving slot capable of receiving a switch, at least one lens assembly disposed on the wall plate, a printed circuit board having at least one light emitting diode and interface wires electrically connecting the night lighting system to a power switch. The lens assembly has a chamber protruding from a back surface of the wall plate, and a lens covering a front end of the chamber. The chamber is capable of receiving at least a portion of the light emitting diode, such that, light from the light emitting diode passes though the lens to illuminate an area around the switch.

14 Claims, 6 Drawing Sheets

NIGHT LIGHTING SYSTEM

This non-provisional application claims priority under 35 U.S.C. sctn. 119(e) from U.S. Provisional Application No. 60/706,868 filed on Aug. 10, 2005, the entire contents of which are hereby incorporated by reference.

FIELD OF THE INVENTION

The present invention relates generally to a night lighting systems, and, more particularly, to a night lighting system for illuminating an area around (i.e., in the vicinity of) a switch.

BACKGROUND OF THE INVENTION

In most of the homes/hotels the preferred locations have no nightlight outlets but do have wall switches and because of this in the night when the main light source(s) are turned off, people may stumble or fall due to inadequate light or illumination. Generally, most people at night search for the switches to turn on the bathroom light or any other light outlet. On doing this people injure themselves because of stumbling or hitting something due to no light. Keeping the safety concerns in mind, such a situation should be avoided. Solutions for night lighting including bulbs and other lighting means are either very costly with a multitude of technicalities involved or are not capable of providing enough lighting.

Most of the nightlights of such nature do not provide sufficient lighting that addresses such problems. In order to solve such problems, most of the people switch on the bathroom light throughout the entire night. Generally, people staying in hotels can be seen doing such type of acts because most of the hotels lack night lighting arrangements. Such acts results in more power consumption and leading to huge electricity bills for the service provider. Research in the United States has shown that by avoiding the use of bathroom light as night light, about $30 a year per room may be saved. This can be made possible by using night light used with AC outlets or switches built with a NEON bulb or a wall switch that incorporates light emitting diodes (LEDs). But these nightlight systems are very dim, expensive, have limited life, heat issues, and can be easily removed which may be a problem with kids or guests. And these nightlights can not be placed in those areas where standard outlets are absent to support standard nightlights (typical to most bathrooms).

Accordingly, the present scenario is punctuated by an emerging need of a system which addresses all the shortfalls of the conventional outlet type devices and provides for a long lasting adequate light or illumination at the switch in home/hotel in a simple, appealing, power saving, and cost effective manner.

SUMMARY OF THE INVENTION

In view of the foregoing disadvantages inherent in the prior arts, the general purpose of the present invention is to provide a night lighting system configured to include all the advantages of the prior arts, and to overcome the drawbacks of the prior arts.

In one aspect, the present invention provides a night lighting system retrofittable with existing wall switches for illuminating an area around the wall switches. The night lighting system comprises: a wall plate having at least one switch receiving slot capable of receiving a switch; at least one lens assembly disposed on the wall plate; a printed circuit board having at least one light emitting diode, the printed circuit board engaged to a back surface of the wall plate; and interface wires electrically connecting the night lighting system to a power switch. The lens assembly has a chamber protruding from the back surface of the wall plate, and a lens covering a front end of the chamber. The chamber is capable of receiving at least a portion of the light emitting diode, such that, light from the light emitting diode passes though the lens to illuminate an area around the switch. The night lighting system provides a long lasting adequate light or illumination at the switch or in home/hotel in a simple, appealing, and cost effective manner.

In yet another aspect, the present invention provides a night lighting system, comprising: a wall plate having a switch receiving slot capable of receiving a switch; a plurality of lens assemblies disposed on the wall plate around the switch receiving slot; a U-shaped printed circuit board, the printed circuit board engaged to a back surface of the wall plate; and interface wires connecting the night lighting system to an AC switch. The lens assemblies has a chamber protruding from the back surface of the wall plate, and a lens covering a front end of the chamber, the lens embedded in a thickness of the wall plate. The U-shaped printed circuit board has a plurality of light emitting diodes, and a plurality of resistors capable of reducing hotspots and removing heat evenly from the printed circuit board. The interface wires have a stranded portion for facilitating wire dressing, and a copper stud end portion for connection to a screw terminal contact or to a push-pop clamp contact. The chambers of the lens assemblies are capable of receiving at least a portion of the light emitting diodes, such that, light from light emitting diodes passes though the lens to illuminate an area around the switch.

These together with other aspects of the present invention, along with the various features of novelty that characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there are illustrated exemplary embodiments of the present invention.

BRIEF DESCRIPTION OF THE DRAWINGS

The advantages and features of the present invention will become better understood with reference to the following more detailed description and claims taken in conjunction with the accompanying drawings, wherein like elements are identified with like symbols, and in which:

Like reference numerals refer to like parts throughout the description of several views of the drawings.

DETAILED DESCRIPTION OF THE INVENTION

The exemplary embodiments described herein detail for illustrative purposes are subject to many variations in structure and design. It should be emphasized, however that the present invention is not limited to a particular night lighting system as shown and described. It is understood that various omissions, substitutions of equivalents are contemplated as circumstances may suggest or render expedient, but is intended to cover the application or implementation without departing from the spirit or scope of the claims of the present invention.

The terms "first," "second," and the like, herein do not denote any order, quantity, or importance, but rather are used to distinguish one element from another, and the terms "a" and "an" herein do not denote a limitation of quantity, but rather denote the presence of at least one of the referenced item.

The present invention provides a night lighting system retrofittable with existing wall switches for illuminating an area around the wall switches. The night lighting system employs a plurality of light emitting diodes (LEDs) disposed around a switch, such that, an area around the switch is sufficiently illuminated for night lighting in an easy, reliable, power saving, and cost-effective manner.

Figure 1:
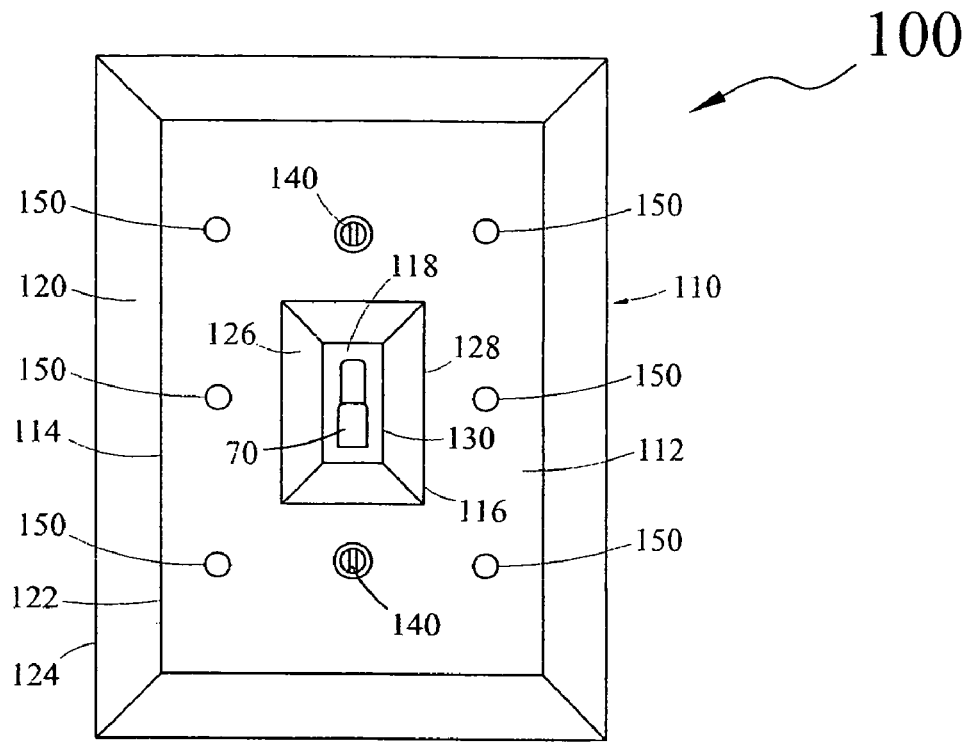
FIG. 1 is a front view of a night lighting system 100 retrofittable with a standard switch 70, according to an exemplary embodiment of the present invention.
Figure 2:
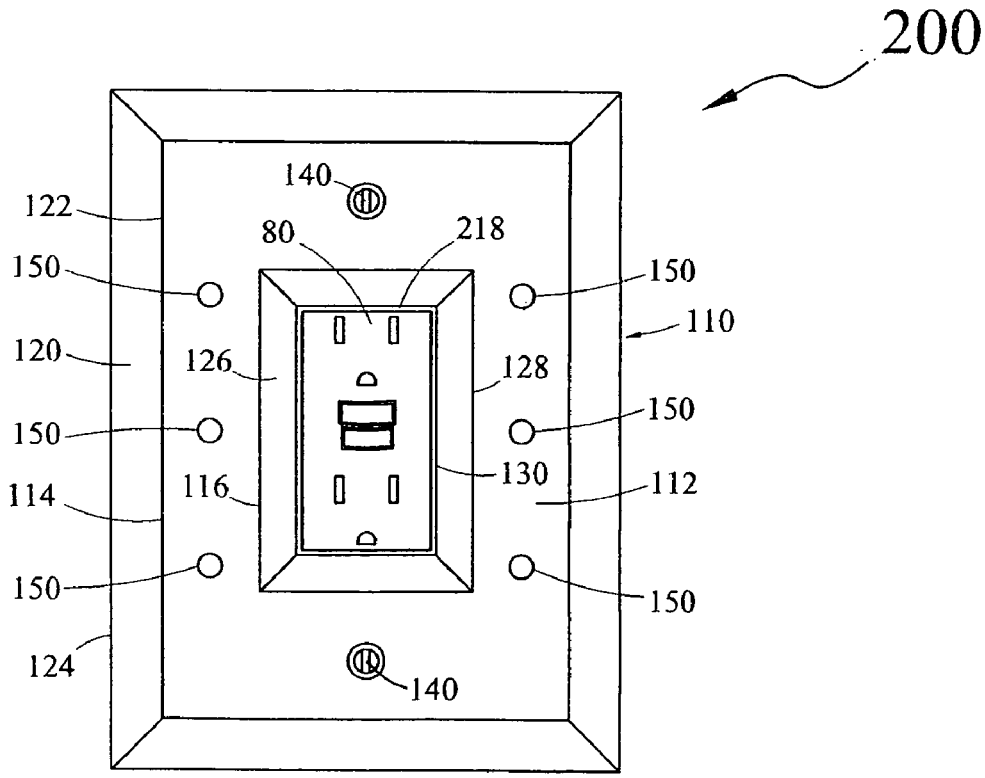
FIG. 2 is a front view of a night lighting system 200 retrofittable with a decor switch 80, according to an exemplary embodiment of the present invention

The night lighting system may be retrofittable with: a standard switch (Refer FIG. 1 illustrating a night lighting system 100 retrofittable with a standard switch 70 disposed on a wall or any other surface); a decor or paddle or rocker switch (Refer FIG. 2 illustrating a night lighting system 200 retrofittable with a decor switch 80 disposed on a wall or any other surface); or other wall switches. In the description, the night lighting system is described with detailed reference to the night lighting system 100, while the same is applicable to the night lighting system 200 other than the retrofittability with different switches.

Referring now to FIGS. 1 and 3-7, the night lighting system 100 comprises a wall plate 110, a plurality of lens assemblies 150, a printed circuit board (PCB) 160 with a plurality of light emitting diodes (LEDs) 170 (See FIG. 7), and interface wires 180 to a power switch, for example, an AC switch.

The wall plate 110 may comprise any design capable of retrofitting with the standard switch 70 and capable of accommodating the LEDs 170 for illuminating an area around the standard switch 70 for night lighting, while also providing an overall aesthetic appearance to the night lighting system 100. The wall plate 110 has: a central panel 112 with an outer periphery 114 and an inner periphery 116; and a switch receiving slot 118 (See FIGS. 3 and 4) capable of receiving the standard switch 70. Depending upon the type of switch, the wall plate 110 configuration and dimensions of the outer periphery 114 and the inner periphery 116 varies. For example, for the night lighting system 200 (See FIG. 2), the switch receiving slot 218 has a larger dimension than the switch receiving slot 118 of the night lighting system 100. The wall plate 110 further has an outer skirt 120 disposed about the outer periphery 114 of the central panel 112, the outer skirt 120 extending inwards from a front to a back of the night lighting system 100, i.e., the outer skirt 120 extends towards the wall when the night lighting system is employed on the wall for retrofitting with the standard switch 70. As shown in FIG. 1, the outer skirt 120 can be an angularly extending portion with a smaller dimension at a first end portion 122 than at a second end portion 124, i.e., an increasing dimension from the first end portion 122 to the second end portion 124. Optionally, an inner skirt 126 may be disposed about the inner periphery 116 of the central panel 112, the inner skirt 126 extending inwards from a front to a back of the night lighting system 100. As shown in FIG. 1, the inner skirt 126 can be an angularly extending portion with a larger dimension at a first end portion 128 than at a second end portion 130, i.e., a decreasing dimension from the first end portion 128 to the second end portion 130.

The lens assemblies 150 comprise a chamber 152 (See FIGS. 5 and 6) protruding from a back surface 146 of the central panel 112 (i.e., a back surface of the wall plate 110), and a lens 154 (See FIG. 6) covering a front end of the chamber 152. The lens assemblies 150 are disposed on the central panel 112 around the switch receiving slot 118. The chambers 152 are capable of receiving at least a portion of the LEDs 170 on the PCB 160, such that, light from the LEDs 170 passes through the lens 154 to illuminate the area around the standard switch 70. Preferably, the lens 154 is a concave lens for effective diffusion of light, while reducing piercing light effect to the eye at night.

Figure 5:
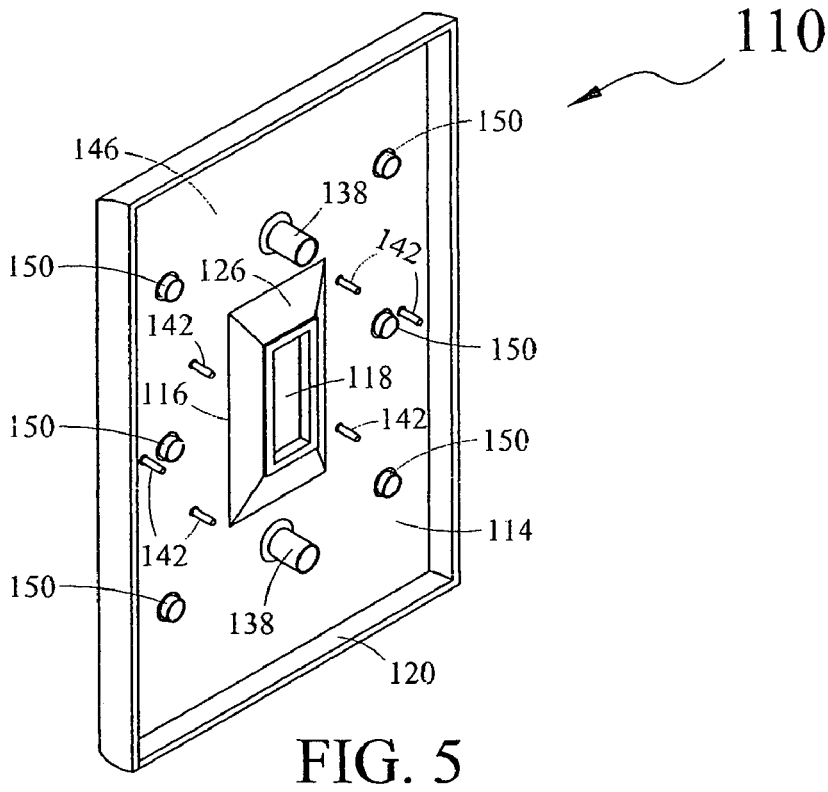
FIG. 5 is a back view of a wall plate 110 of the night lighting system 100, according to an exemplary embodiment of the present invention.

The lens assemblies 150 may comprise any design providing substantial illumination in the area around the standard switch 70 for night lighting. In some designs, the lens 154 may be attached to the central panel 112 of the wall plate 110 using various bonding techniques, such as, thermal bonding (e.g., pattern bonded), ultrasonic bonding, adhesive bonding (e.g., adhesive, resin, latex, and the like), and/or mechanical bonding (e.g., through-air dried attachment, and the like). Alternatively, in one embodiment, as shown in FIG. 5, the lens 154 can be embedded in a thickness of the wall plate 110, more specifically, in a thickness of the central panel 112. For the purpose of description, such a design of the lens assemblies 150 is termed as a 'hidden lens' design. The 'hidden lens' design enhances light direction and the diffusion of light, making light less direct and more pleasant. Also, in the 'hidden lens' design, the lens 154 does not protrude out of the front surface 148 of the central panel 112, thereby reducing the ridges and aberrations on the front surface 148. The 'hidden lens' design provides easy and effective cleaning by flush mounting the lens assemblies 150, thereby reducing dirt, dust, and other contaminant accumulation on the wall plate 110.

The lens assemblies 150 are disposed on two sides of the switch receiving slot 118 in sets of three lens assemblies 150, i.e., a total of six lens assemblies 150. Alternatively, a total of four lens assemblies 150 may be disposed in sets of two lens assemblies 150 on the two sides of the switch receiving slot 118. Other configurations of lens assemblies 150 that provide sufficient illumination for night lighting may be used.

Additionally, the wall plate 110 may have mounting features, for example, hollow protrusions 138 protruding from the back surface 146 of the central panel 112, the hollow protrusions 138 capable of receiving mounting elements 140 (See FIG. 1), such as, screw(s), nail(s), rivet(s), blot(s), and the like) for securely engaging the wall plate 110 to the wall. Optionally, structural features, such as, rib(s), protrusion(s), groove(s), lip(s), shelve(s); barb(s), spoke(s), and the like, may be present to enhance the frictional engagement of the wall plate 110 to the wall.

The wall plate 110 may be made of any material providing sufficient structural integrity to enable the night lighting system 100 to be suitably installed on a wall, while being retrofittable with a switch on the wall. Suitable materials include, but are not limited to, thermoformed plastics, such as polyolefines, polyesters, polybutylene terephthalate, acrylonitrile butadiene styrene (ABS), and the like. Various processes may be employed to custom design the wall plate 110: Suitable processes include, but are not limited to, injection molding; extrusion molding, blow molding, vacuum forming, compression molding, and the like. Additionally, aesthetic decorations and/or designs, product, manufacturer, and/or source identifiers, and the like, may be disposed on one or more surfaces of the wall plate 110, for example, on the front surface of the central panel 112 and/or on the outer skirt 120.

The PCB 160 may be engaged to back surface of the wall plate 110, more specifically, back surface 146 of the central panel 112 using heat staking. Also, the PCB 160 may have engagement features removably engaging with complementary engagement features on the back surface 146 of the central panel 112. For example, the hollow protrusion 138 received through a groove on the PCB 160 (See FIGS. 3 and 4). Also, the wall plate 110 may have posts 142 protruding from the back surface 146 of the central panel 112, the posts 142 capable of being received in grooves on the PCB 160.

Figure 3:
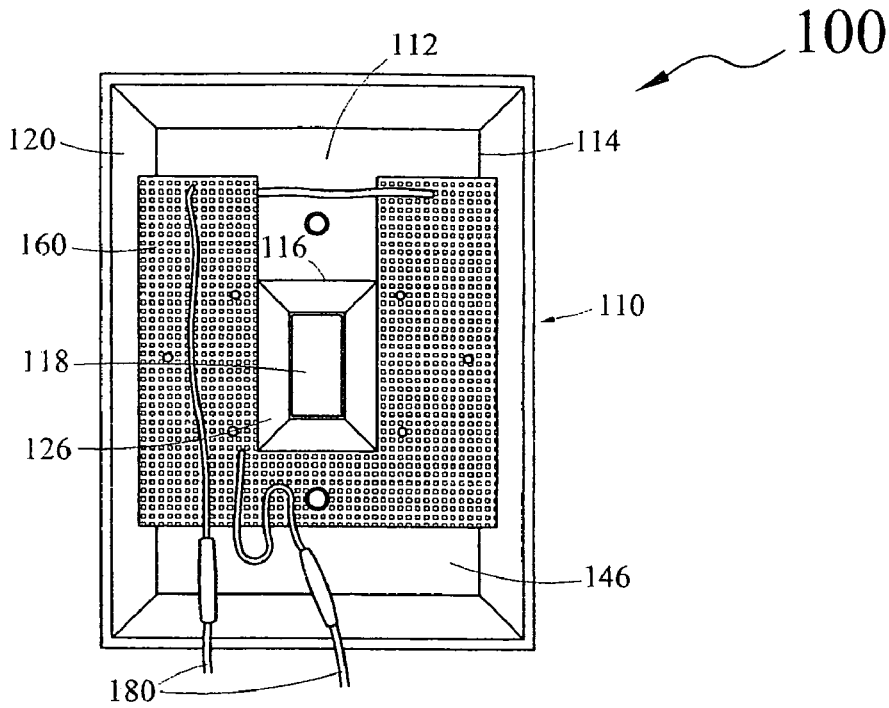
FIG. 3 is a back view of the night lighting system 100 for a two wire switch connection, according to an exemplary embodiment of the present invention.
Figure 4:
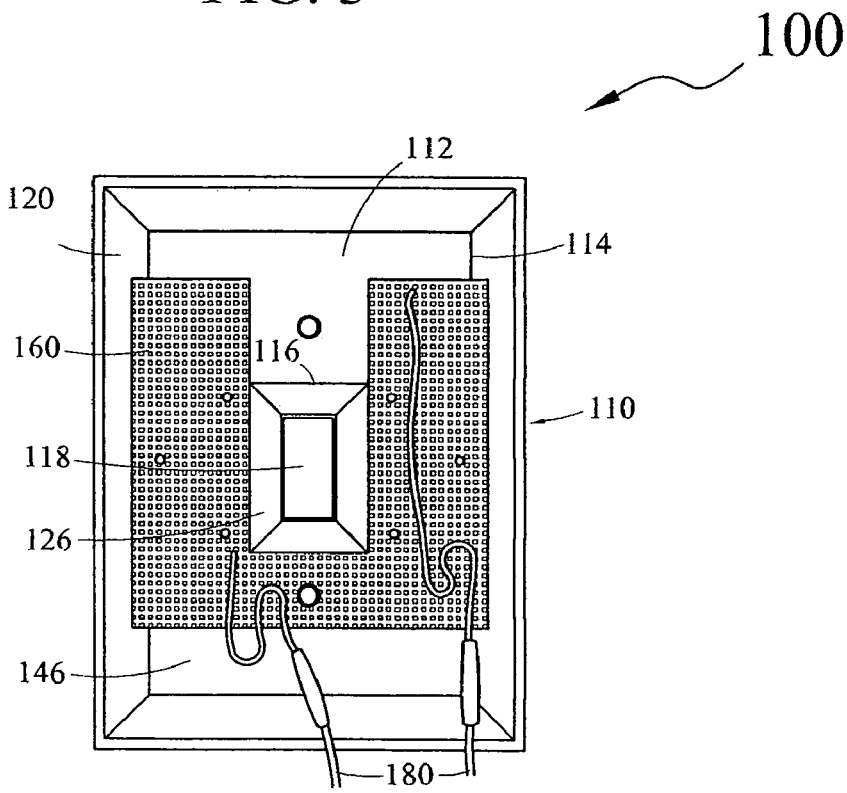
FIG. 4 is a back view of the night lighting system 100 for a three wire switch connection, according to an exemplary embodiment of the present invention.
Figure 8:
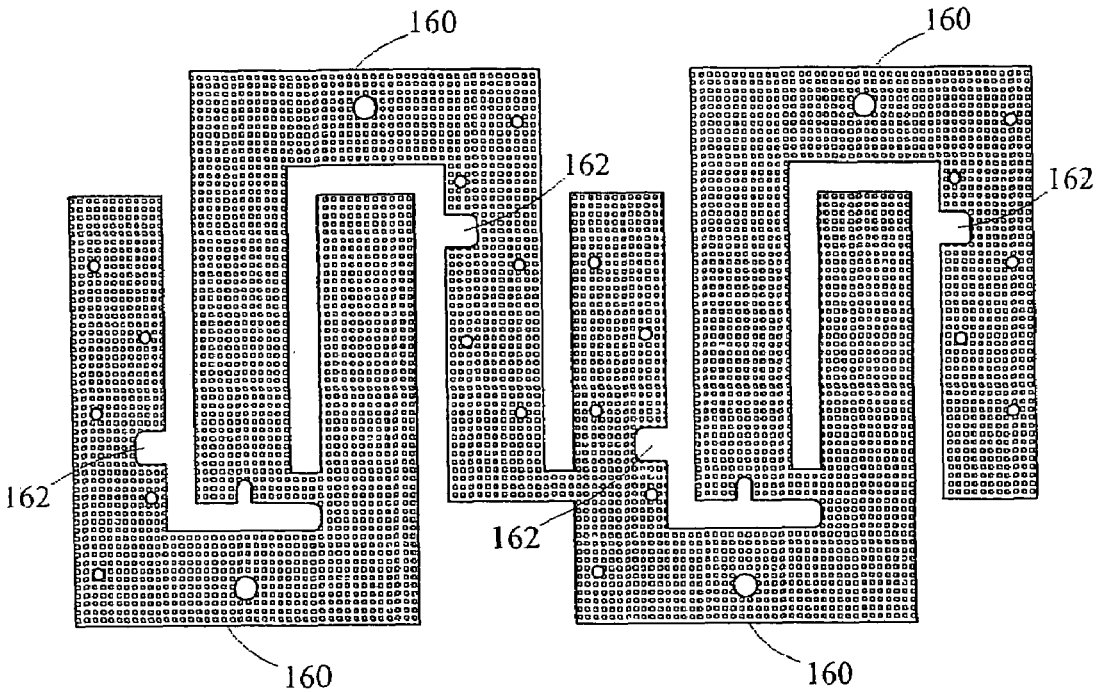
FIG. 8 is representation of a PCB array for a standard switch, according to an exemplary embodiment of the present invention.
Figure 9:
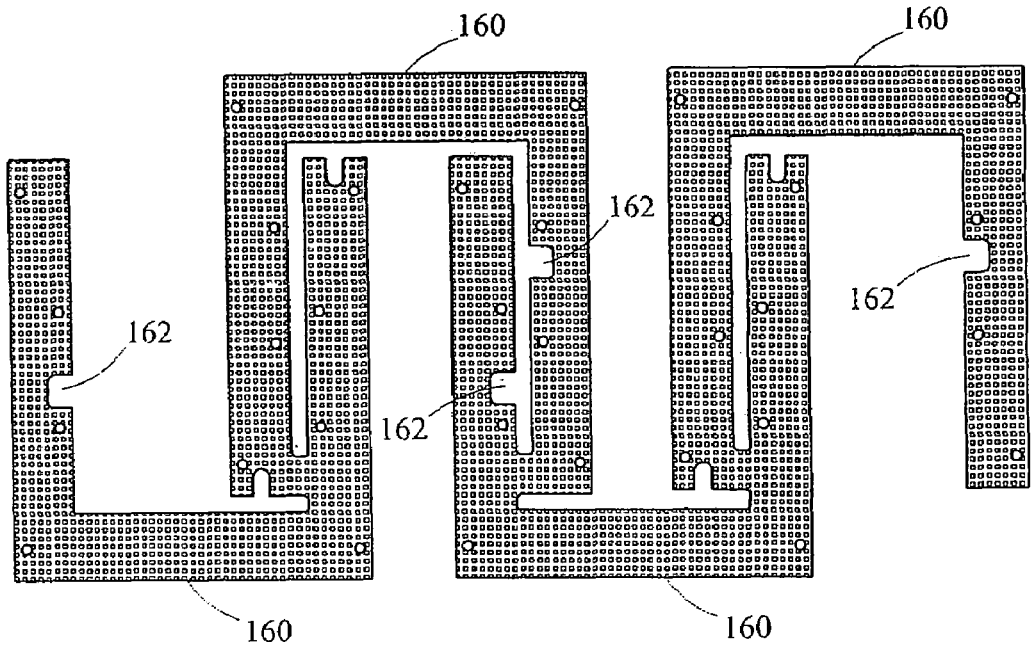
FIG. 9 is representation of a PCB array for a decor switch, according to an exemplary embodiment of the present invention.

The PCB 160 may comprise any design providing LEDs 170 at suitable positions corresponding to lens assemblies 150; such that, each LED 170 may be at least partially received in a LED chamber 152 of a corresponding lens assembly 150 for illuminating the area around the standard switch 70. Preferably, the PCB 160 is designed to optimize the PCB 160 material, such that, a maximum of the PCB 160 surface area may be used, thereby lowering the fabrication cost of the PCB. For example, as shown in FIGS. 3 and 4, the PCB 160 has a U-shaped design. Also, such a U-shaped design aids in the wire dressing when wiring usage requires the longer wire to be dressed to an opposite side of a soldered location. Optionally, the PCB 160 has a notch 162 aiding in easy wire dressing of the interface wires 180. For a standard switch, the night lighting system 100 may have a PCB array of a plurality of PCBs 160, as shown in FIG. 8. Similarly, for a decor switch, the night lighting system 100 may have a PCB array of a plurality of PCBs 160 as shown in FIG. 9.

Figure 6:
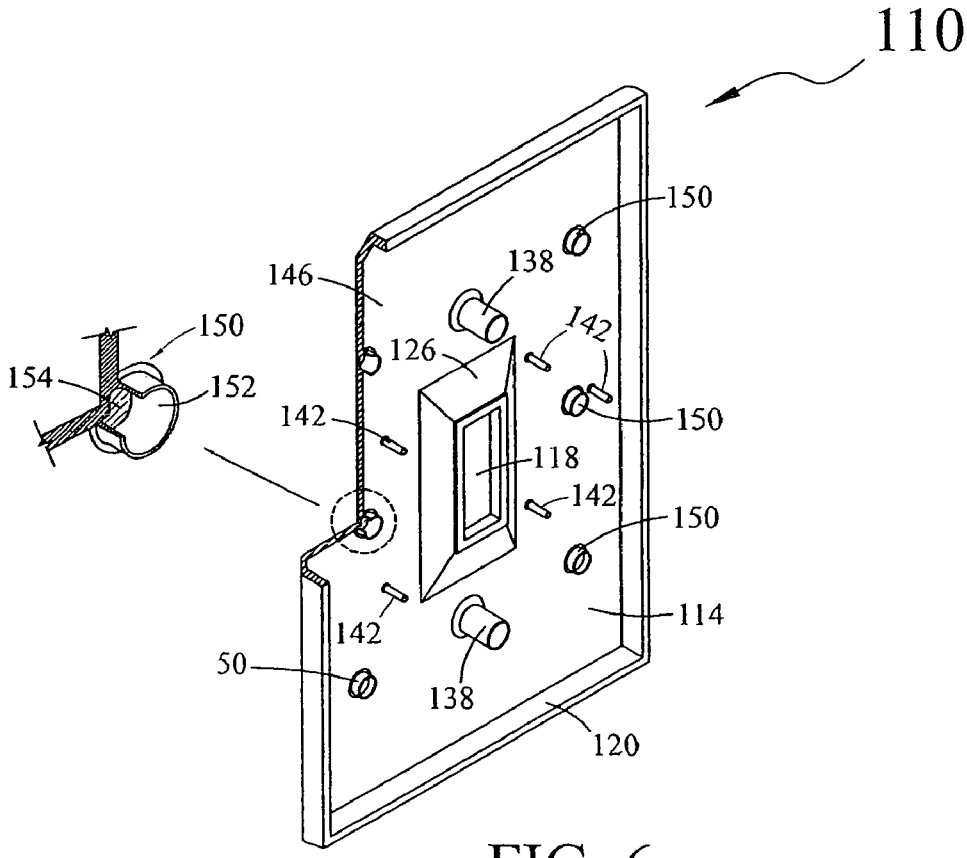
FIG. 6 is a partially cut out back view of the wall plate 110 of FIG. 5 with an exploded view of a lens assembly 150, according to an exemplary embodiment of the present invention.
Figure 7:
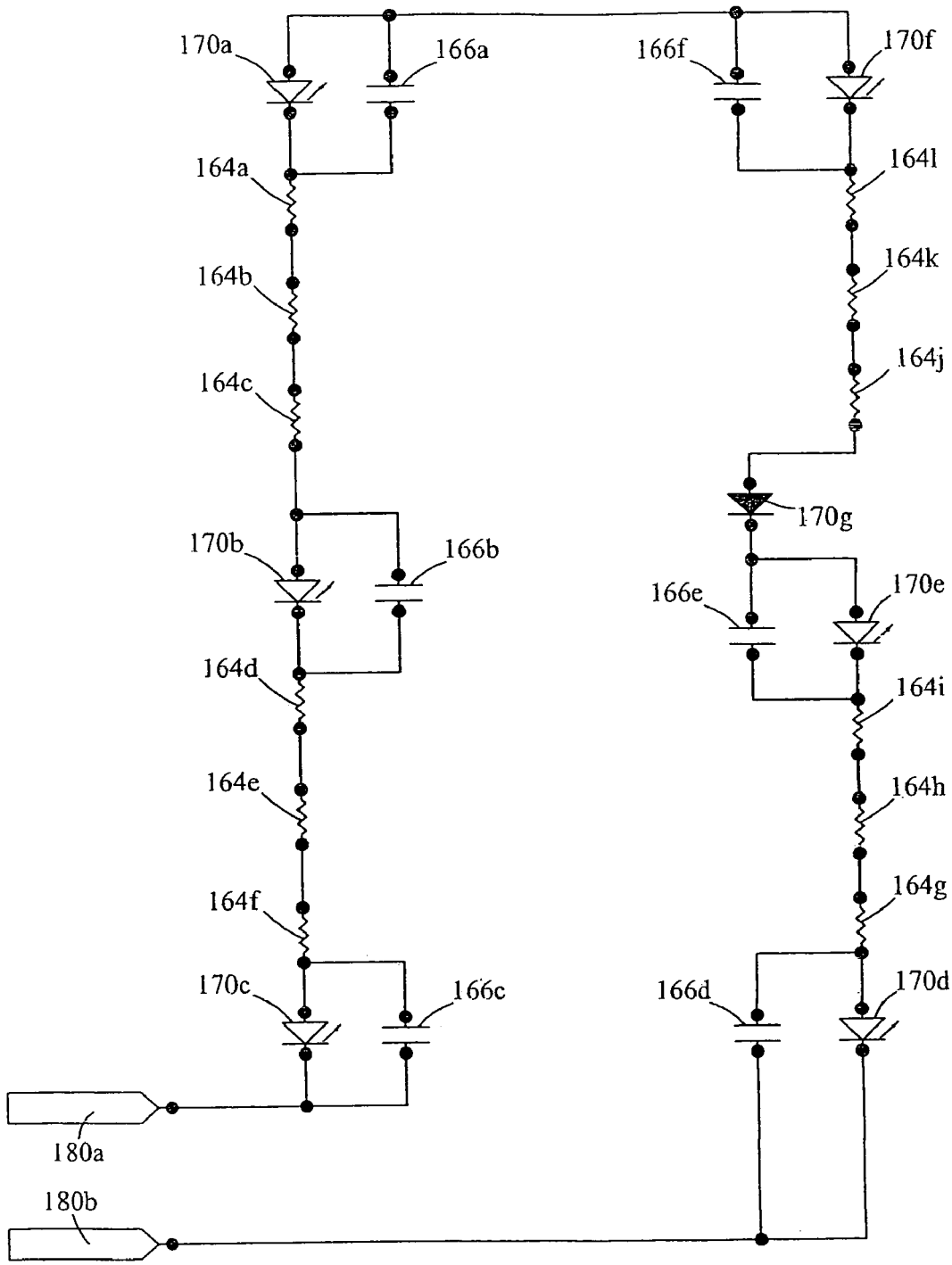
FIG. 7 is a schematic representation of a printed circuit board 160 of the night lighting system 100, according to an exemplary embodiment of the present invention.

Also, the PCB 160 has been designed to meet a heat design goal of less than or equal to about 1 watt per six square inches of PCB 160. The PCB 160 has a plurality of resistors for dissipating heat generated in the PCB 160, i.e., reducing the hotspots and removing heat evenly from the PCB 160. Referring to FIG. 6, in one embodiment, the PCB 160 comprises six LEDs 170 numbered individually as 170*a*, 170*b*, 170*c*, 170*d*, 170*e*, 170*f* connected in series with twelve resistors 164*a*, 164*b*, 164*c*, 164*d*, 164*e*, 164*f*, 164*g*, 164*h*, 164*i*, 164*j*, 164*k*, 164*l*. Also, an additional diode 170*g* (1 amp, 400 volt) is present. The interface wires 180 that connect the night lighting system 100 to the AC switch are represented as 180*a*, 180*b* in FIG. 6. Additionally, the PCB 160 has capacitors 166*a*, 166*b*, 166*c*, 166*d*, 166*e*, 166*f* placed across the LEDs 170*a*, 170*b*, 170*c*, 170*d*, 170*e*, 170*f* for protecting the LEDs 170*a*, 170*b*, 170*c*, 170*d*, 170*e*, 170*f* from an electro static discharge (ESD) from an internal and/or an external source. In one embodiment, the capacitors 166*a*, 166*b*, 166*c*, 166*d*, 166*e*, 166*f* have a capacitance of about 0.01 micro farad to about 0.1 micro farad.

Overall, the night lighting system 100 (i.e., the wall plate 110 and the PCB 160) may be designed to meet the requirements of electric equipment regulatory authorities (UL and CSA). The night lighting system 100 uses fire rated materials for construction. Also, the design provides adequate intrusion protection to minimize shock hazards. As discussed above, the heat design of the night lighting system 100 is such that, safe operating temperatures are maintained.

To meet the UL requirements, the interface wires 180 (may be made of 12 or 14 gauge solid copper wire. The interface wires 180 that connect the night lighting system 100 to the AC switch may be positioned to allow either for a: two wire switch connection, wherein the interface wires 180 are disposed on same side of the standard switch 70, i.e., on one side of the switch receiving slot 118 (See FIG. 3); or a three wire switch connection, wherein interface wires 180 disposed on opposite sides of the standard switch 70; i.e., on opposite sides of the switch receiving slot 118 (See FIG. 4). Accordingly, the wire dressing for the two wire switch connection is different from the three wire switch connection. Due to the availability of the night lighting system 100, 200 in two different wire switch connection designs, i.e., two wire switch connection and the three wire switch connection, the invention avoids the need for two products and eliminates the buyer's confusion to make the correct purchase.

The interface wires 180 may be designed to provide a stranded construction, for example, the interface wires 180 have a stranded portion 182 for providing convenient wire dressing. Also, the interface wires have a copper stud end portion 184, allowing connection to be made either to a screw terminal contact or to a push-pop clamp contact that are provided on most standard wire switches.

Preferably, the LEDs 170 used in the night lighting system have a life span of about 20 years, thereby providing a long lasting night lighting solution. Further, the LEDs 170 may be of a single or multiple colors, such as, red, green, blue, white, orange, yellow, and the like. Alternatively, or in addition, the lens. 154 may be colorized to provide light of other shades, such as, pink, purple, and the like.

Optionally, the night lighting system 100 may further comprise an on/off switch (not shown) for enabling/disabling the night lighting system, i.e., powering on/off the LEDs 170. Alternatively, or in addition, the night lighting system 100 may further comprise an illumination adjustment switch for dimming/brightening the area around the standard switch 70, i.e., for adjusting the level of illumination around the standard switch 70.

Figure 10:
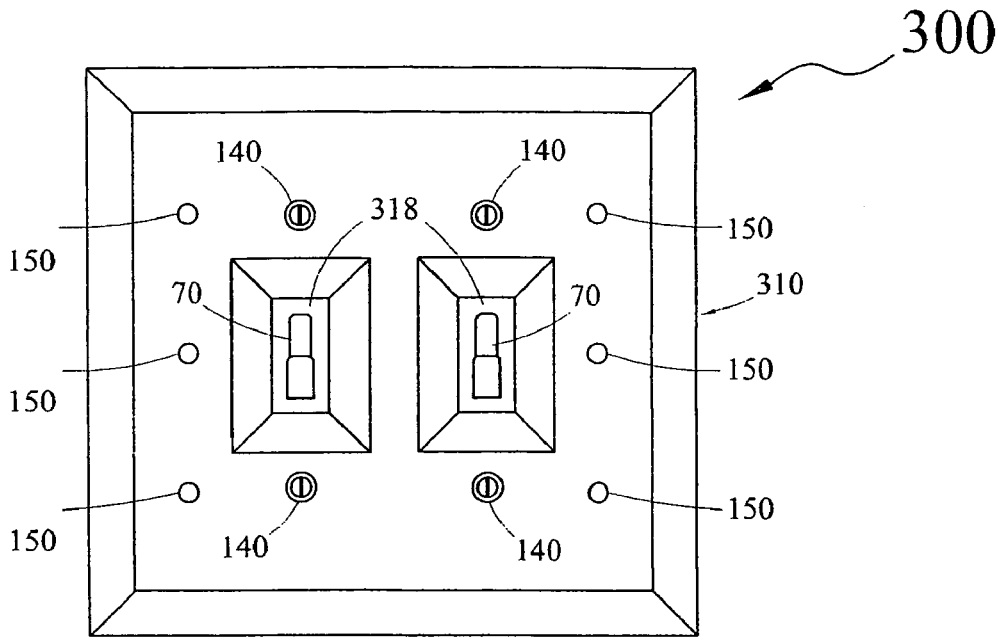
FIG. 10 is a front view of a night lighting system 300 retrofittable with two standard switches 70, according to an exemplary embodiment of the present invention.
Figure 11:
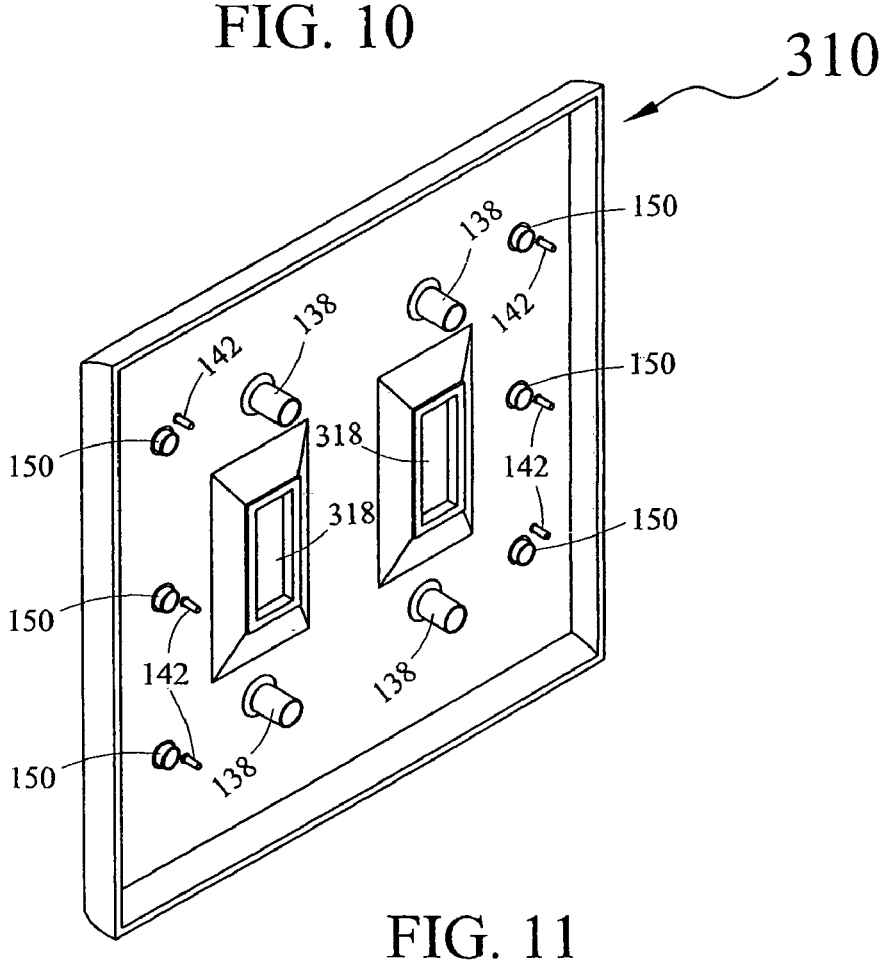
FIG. 11 is a back view of a wall plate 310 of the night lighting system 300, according to an exemplary embodiment of the present invention.

In another embodiment, the present invention provides a night lighting system retrofittable with two standard switches or two decor switches, and may be termed as a dual night lighting system. For example, as shown in FIG. 10, a night lighting system 300 retrofittable with two standard switches 70. The night lighting system 300 comprises a dual wall plate 310, a plurality of lens assemblies 150, a PCB with LEDs, and interface wires to an AC switch. The dual wall plate 310 may have a design similar to the wall plate 110, or any other design that is capable of accommodating the LEDs for illuminating an area around the standard switches 70 for night lighting. The wall plate 310 has two switch receiving slots 318 capable of receiving two standard switches 70. In other embodiments, the present invention may provide night lighting systems retrofittable with multiple standard switches or multiple decor switches, or a combination of at least one of the foregoing.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is understood that various omissions, substitutions of equivalents are contemplated as circumstance may suggest or render expedient, but is intended to cover the application or implementation without departing from the spirit or scope of the claims of the present invention.

What is claimed is:

1. An AC night lighting system, comprising:

an A/C electrical power source having at least a hot wire and a neutral wire;

an electrical power switch connected in line with said hot wire;

a wall switchplate cover adapted for housing said electrical power switch, having a front face and a rear face wherein said front face has a generally rectangular, planar raised central area and a peripheral edge tapering toward the rear face;

a plurality of heat stake posts extending normally from said back face;

at least four lens receiving orifices formed therethrough said cover;

at least four concave lens assemblies residing in the wall plate lens receiving orifices, adjacent said front face, a lens chamber extending normally from about an edge of said lens receiving orifices;

at least two interface wires;

a U shaped printed circuit board;

a 1 watt per six square inch heat limited switch bypass circuit having at least four light emitting diodes, at least eight resistors, at least four 0.01 to 0.1 μF capacitors, and at least one 1 amp/400 volt diode disposed thereon said U shaped printed circuit board so as to form an array of electrically connected components connected by said interface wires to the hot wire of said A/C electrical power source on each side of said switch so as to operate in parallel with said switch on said A/C electrical power source when said switch is open; and a plurality of heat stake orifices formed through said circuit board;

wherein said circuit board is affixed to said rear face of said wall switchplate cover by said heat stake posts that extend through said heat stake orifices and are heat welded onto said circuit board, and wherein the chamber is capable of receiving at least a portion of the light emitting diode, such that, light from the light emitting diode passes though the lens to illuminate an area around the switch when said electrical power switch is open.

2. The night lighting system of claim 1, wherein the lens is embedded in a thickness of the wall plate.

3. The night lighting system of claim 1, wherein said four lens assemblies are disposed in sets of two lens assemblies on two sides of the switch receiving slot.

4. The night lighting system of claim 1, wherein six lens assemblies are disposed in sets of three lens assemblies on two sides of the switch receiving slot and said 1 watt per six square inch heat limited switch bypass circuit has six light emitting diodes, 12 resistors and, six 0.01 to 0.1 μF capacitors.

5. The night lighting system of claim 1, wherein said 1 watt per six square inch heat limited switch bypass circuit said further comprises a plurality of resistors capable of reducing hotspots and removing heat evenly from said circuit.

6. The night lighting system of claim 1, wherein said 1 watt per six square inch heat limited switch bypass circuit further comprises a capacitor placed across the light emitting diode for protecting the light emitting diode from electro static discharge from an internal or external source.

7. The night lighting system of claim 1, wherein the interface wires are positioned on one side of the switch for a two wire switch connection.

8. The night lighting system of claim 1, wherein the interface wires are positioned on opposite sides of the switch for a three wire switch connection.

9. The night lighting system of claim 1, wherein the interface wires have a stranded portion for facilitating wire dressing.

10. The night lighting system of claim 1, wherein the interface wires have a copper stud end portion.

11. A night lighting system, comprising:

an A/C electrical power source;

an A/C light switch;

a wall plate having a switch receiving slot, the switch receiving slot capable of receiving said light switch;

a plurality of lens assemblies disposed on the wall plate around the switch receiving slot, the lens assemblies having a chamber protruding from a back surface of the wall plate, and a lens covering a front end of the chamber, the lens embedded in a thickness of the wall plate;

a U shaped circuit board with a 1 watt per six square inch heat limited circuit disposed thereon having a plurality of light emitting diodes, and a plurality of resistors in an electrically conductive arrangement that is capable of reducing hotspots and removing heat evenly from the means wherein the circuit board is engaged to the back surface of the wall plate; and a plurality of interface wires connecting the circuit to the electrical power source in paralleled with said AC switch, the interface wires having a stranded portion for facilitating wire dressing, and a copper stud end portion for connection to a screw terminal contact or to a push-pop clamp contact;

wherein the chambers of the lens assemblies are capable of receiving at least a portion of the light emitting diodes, such that, light from light emitting diodes passes though the lens to illuminate an area around the switch.

12. The night lighting system of claim 11, wherein the interface wires are positioned on one side of the switch for a two wire switch connection.

13. The night lighting system of claim 11, wherein the interface wires are positioned on opposite sides of the switch for a three wire switch connection.

14. The night lighting system of claim 11, wherein the further has a capacitor placed across each light emitting diode for protecting the light emitting diodes from electro static discharge from an internal or external source.

* * * * *